US010900476B2

(12) United States Patent
Brun et al.

(10) Patent No.: US 10,900,476 B2
(45) Date of Patent: Jan. 26, 2021

(54) NATURAL GAS RECIPROCATING COMPRESSOR

(71) Applicant: Southwest Research Institute, San Antonio, TX (US)

(72) Inventors: Klaus Brun, Helotes, TX (US); Jason C. Wilkes, Fair Oaks Ranch, TX (US)

(73) Assignee: Southwest Research Institute, San Antonio, TX (US)

( * ) Notice: Subject to any disclaimer, the term of this patent is extended or adjusted under 35 U.S.C. 154(b) by 208 days.

(21) Appl. No.: 15/255,987

(22) Filed: Sep. 2, 2016

(65) Prior Publication Data

US 2018/0066802 A1 Mar. 8, 2018

(51) Int. Cl.

| | |
|---|---|
| ***F17D 1/07*** | (2006.01) |
| ***F04B 35/01*** | (2006.01) |
| ***F04B 37/18*** | (2006.01) |
| ***F04B 39/00*** | (2006.01) |
| ***F04B 39/12*** | (2006.01) |
| ***F04B 39/16*** | (2006.01) |
| ***F04B 35/04*** | (2006.01) |
| ***F04B 39/04*** | (2006.01) |
| ***F17D 1/08*** | (2006.01) |

(Continued)

(52) U.S. Cl.

CPC ..... *F04B 39/12* (2013.01); *F04B 35/01* (2013.01); *F04B 35/04* (2013.01); *F04B 37/18* (2013.01); *F04B 39/0005* (2013.01); *F04B 39/041* (2013.01); *F04B 39/16* (2013.01); *F17D 1/04* (2013.01); *F17D 1/07* (2013.01); *F17D 1/08* (2013.01); *F17D 1/12* (2013.01)

(58) Field of Classification Search

CPC ..... F04B 35/01; F04B 35/04; F04B 37/18; F04B 39/0005; F04B 39/041; F04B 39/12; F04B 39/16; F17D 1/07; F17D 1/04; F17D 1/08; F17D 1/12

USPC ..... 417/415

See application file for complete search history.

(56) References Cited

U.S. PATENT DOCUMENTS 4,477,237 A * 10/1984 Grable ..... F04B 53/00 417/454

5,390,492 A * 2/1995 Levendis ..... F01N 3/023 55/302

(Continued)

OTHER PUBLICATIONS

Bobenhausen; "Simplified Design of HVAC Systems"; Wiley-Interscience Publication, Parker/Ambrose Series of Simplified Design Guides, pp. 344-345.

(Continued)

*Primary Examiner* — Connor J Tremarche

(74) *Attorney, Agent, or Firm* — Grossman Tucker Perreault & Pfleger PLLC

(57) ABSTRACT

A reciprocating compressor including a compressor frame including a drive shaft received therein, a rotary to linear motion converter coupling the drive shaft and a first end of a piston rod, a piston coupled to a second end of the piston rod, a compression cylinder in which the piston is received, an inlet valve coupled to the compression cylinder and a discharge valve coupled to the compression cylinder, a pressure casing encasing the compressor frame and the rotary to linear motion converter, a motor coupled to the drive shaft, wherein the motor is located external to the pressure casing, and a mechanical seal coupled between the drive shaft and the pressure casing.

20 Claims, 7 Drawing Sheets

(51) Int. Cl.
*F17D 1/12* (2006.01)
*F17D 1/04* (2006.01)

(56) References Cited

U.S. PATENT DOCUMENTS

| | | | | |
|---|---|---|---|---|
| 5,445,119 | A | 8/1995 | Regueiro | |
| 5,515,769 | A * | 5/1996 | Basinski | F04B 39/04 417/420 |
| 6,832,583 | B2 | 12/2004 | Hayman | |
| 2010/0095690 | A1 * | 4/2010 | Bush | F04B 5/00 62/115 |
| 2011/0072964 | A1 * | 3/2011 | Gerbi | F04B 51/00 92/5 R |
| 2015/0107681 | A1 | 4/2015 | Killeen et al. | |
| 2015/0125323 | A1 | 5/2015 | Stair et al. | |
| 2015/0240814 | A1 | 8/2015 | Snyder et al. | |
| 2015/0328578 | A1 | 11/2015 | Deckman et al. | |

OTHER PUBLICATIONS

PetroWiki: SPE International "Centrifugal Compressor"; <<http://petrowiki.org/Centrifugal_compressor>> (accessed Aug. 21, 2016) (8 pgs).

PetroWiki; SPE International "Reciprocating Compressor"; <<http://petrowiki.org/Reciprocating_compressor>> (accessed Aug. 26, 2016) (23 pgs).

Ross, et al; "Compressor Seal Selection and Justification"; Proceedings of the Thirty-Second Turbomachinery Symposium; 2003, pp. 167-178.

* cited by examiner

NATURAL GAS RECIPROCATING COMPRESSOR

FIELD

The present disclosure relates to a natural gas reciprocating compressor and, preferably, a sealed natural gas reciprocating compressor.

BACKGROUND

Reciprocating compressors are used for natural gas applications where reduced flow and relatively high-pressure rise are needed; thus, they move a substantial portion of natural gas. Typically, reciprocating compressors utilize pressure packings to seal around the piston rod and the compression cylinder, i.e., the chamber where the gas is compressed. FIG. 1 illustrates an example of a reciprocating compressor 100. The reciprocating compressor 100 includes a compressor frame 102 with a crankshaft 104 located therein. Rotation of the drive-shaft/crankshaft 104 drives a connecting rod and crosshead 106, which transfers the motion of the connecting rod into a linear motion. A piston rod 108 is affixed to and driven laterally in a reciprocating manner by the cross-head. The piston rod 108 in turn reciprocates a piston 110 within a compression cylinder (i.e., the compression chamber) 112. The pressure packing 114 is positioned where the piston rod 108 enters the compression cylinder 112. A distance piece 118 provides spacing between the connecting rod 106 and the compression cylinder 112.

The pressure packing 114 prevents pressurized gas from leaking out of the compression cylinder 112, into the distance piece 118, and out into the environment. The pressure packing 114 leaks approximately 1% of the compressed gas from the compressor. Further, as the seals wear out the leakage and emissions increase fairly dramatically. Accordingly, room for improvement remains in the design of reciprocating gas compressors.

SUMMARY

An aspect of the present disclosure is directed to a reciprocating compressor. The compressor includes a compressor frame including a drive shaft received therein, a rotary to linear motion converter coupling the drive shaft and a first end of a piston rod, and a piston coupled to a second end of the piston rod. The piston is received in a compression cylinder. An inlet valve is coupled to the compression cylinder and a discharge valve is coupled to the compression cylinder. Further, a pressure casing encasing the compressor frame and the rotary to linear motion converter is provided. A motor is preferably coupled to the drive shaft, wherein the motor is located external to the pressure casing, and a mechanical seal coupled between the drive shaft and the pressure casing.

The mechanical seal is preferably a rotating seal and, more preferably, the rotating seal is a dry gas seal. Preferably, the rotary to linear motion converter comprises a connecting rod driven by the drive shaft, and a crosshead affixed to the connecting rod, wherein the crosshead is configured to transfer the rotational motion of the connecting road to a linear motion, the crosshead being slidably mounted in a crosshead guide and the piston rod is coupled to the crosshead. Also preferable, a distance piece is provided between the crosshead guide and the compression cylinder and the piston rod is supported by the distance piece. Further, a pressure packing is, in any of the above embodiments, received between the compression cylinder and the distance piece.

In further embodiments of the above, a second inlet valve is coupled to the compression cylinder and a second discharge valve is coupled to the compression cylinder, such that the reciprocating compressor is a double acting compressor. In any of the embodiments above, a reclamation system is provided including a flow pathway coupled to the pressure casing and to the compression cylinder inlet valve. In preferred embodiments, a filter is coupled to the flow pathway of the reclamation system and filters the reclaimed process gas.

Another aspect of the present disclosure relates to a supply line including a reciprocating compressor affixed in the supply line flow path. The reciprocating compressor includes any of the above reciprocating compressors, wherein the inlet valve couples a first portion of the supply line to the compression cylinder and the discharge valve couples the compression cylinder to a second portion of the supply line. In preferred embodiments, the supply line is a natural gas pipeline.

Yet a further aspect of the present disclosure relates to a method of supplying a compressible process fluid. The method includes providing a compressible process fluid to a reciprocating compressor as described in any of the above embodiments from a first portion of a supply line. The method further includes compressing the compressible process fluid in the compression cylinder by rotating the drive shaft, preferably with the motor, converting the rotary motion to linear motion with the rotary linear motion converter, reciprocating the piston rod and the piston within the compression cylinder, and discharging the compressible process fluid into the second portion of the supply line. Preferably, the pressure casing is held in the range of the process gas suction and discharge pressures.

BRIEF DESCRIPTION OF DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

The present disclosure relates to a natural gas reciprocating compressor and, preferably, a sealed natural gas reciprocating compressor. The natural gas reciprocating compressor now preferably includes a pressurized casing. The pressurized casing reduces or eliminates leakage through the pressure packing, which leakage increases with the wearing of the pressure packing.

Preferably, the only leakage path for process gas through the pressure casing is for accommodating the drive-shaft input. This penetration is sealed to prevent gas leakage, and preferably, with a mechanical seal, a rotating seal, or dry gas seal. A mechanical seal is reference to the use of a primary (hard) sealing surface against a secondary (carbon or the like) sealing surface. A rotating seal may be understood as a mechanical seal that allows a rotating element to pass through a sealed case. A dry gas seal is reference to a mating (rotating) ring and a primary (stationary) ring. During operation, the lifting geometry in the rotating ring generates a fluid-dynamic lifting force causing the stationary ring to separate and create a gap between the two rings. Further details of the dry gas seal are described herein. There may be circumstances where other leakage paths may be present, such as in gaps in the casing; these pathways should also be mitigated.

The pressurized casing is preferably held at a pressure in the range of the suction and discharge pressure of the compression cylinder and system including all values and ranges therein, or may be a function of the target compression pressure. Operating at this pressure now allows for a reclaiming system to collect and recompress the leakage gas. In other embodiments, the pressure casing operates at the piston suction pressure. Operating at this pressure allows for further reduced leakage out of the packing seals. It is contemplated that the arrangements herein may provide a reduction in compression power by increasing efficiency, which may also help to reduce emissions from driving equipment.

In preferred embodiments, the reciprocating compressors described herein are used to increase gas pressure relative to a given suction. In the oil and gas industry, such compressors are primarily used to move natural gas from one place to the next. The configuration herein is believed to improve on the original compressor configuration by reducing emissions resulting from leakage out of the rod-packing seals. Further, while natural gas is described above as the preferred process fluid, other compressible process fluids and applications are contemplated herein, including chemical plant and refrigeration plant applications. A compressible process fluid is understood herein as a fluid, which as a liquid or gas, which volume changes with changes in pressure acting upon the fluid.

Figure 1:
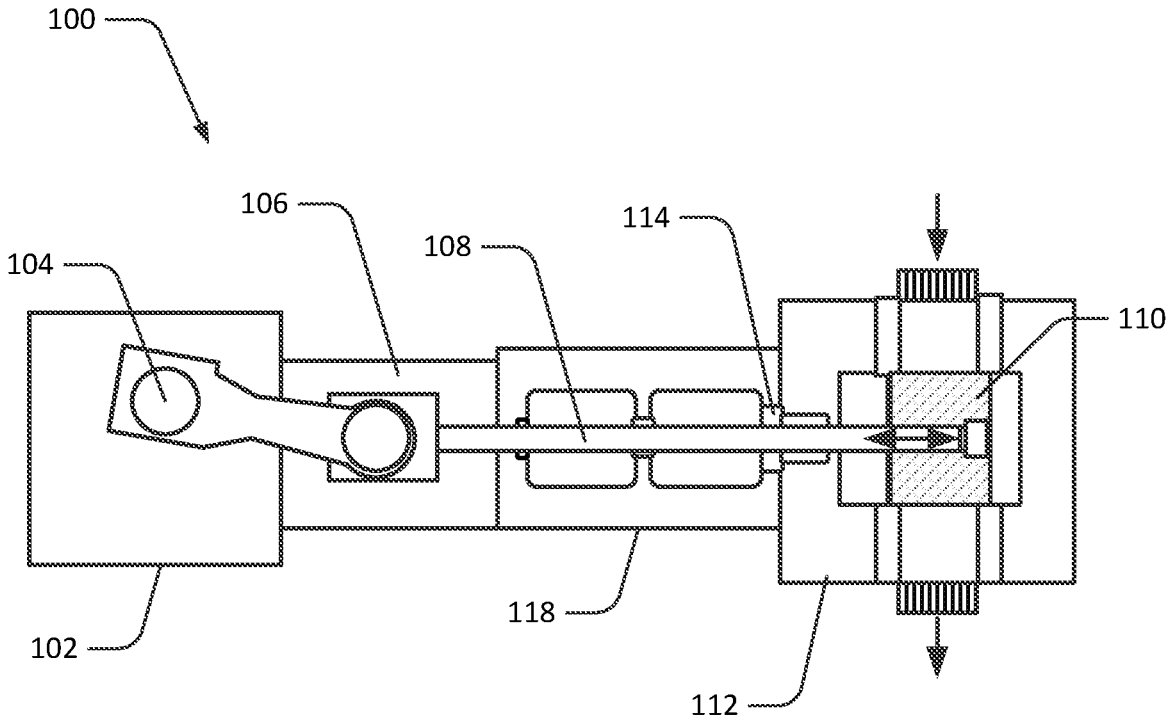
FIG. 1 PRIOR ART
FIG. 1 illustrates an embodiment of a reciprocating compressor.
Figure 2A:
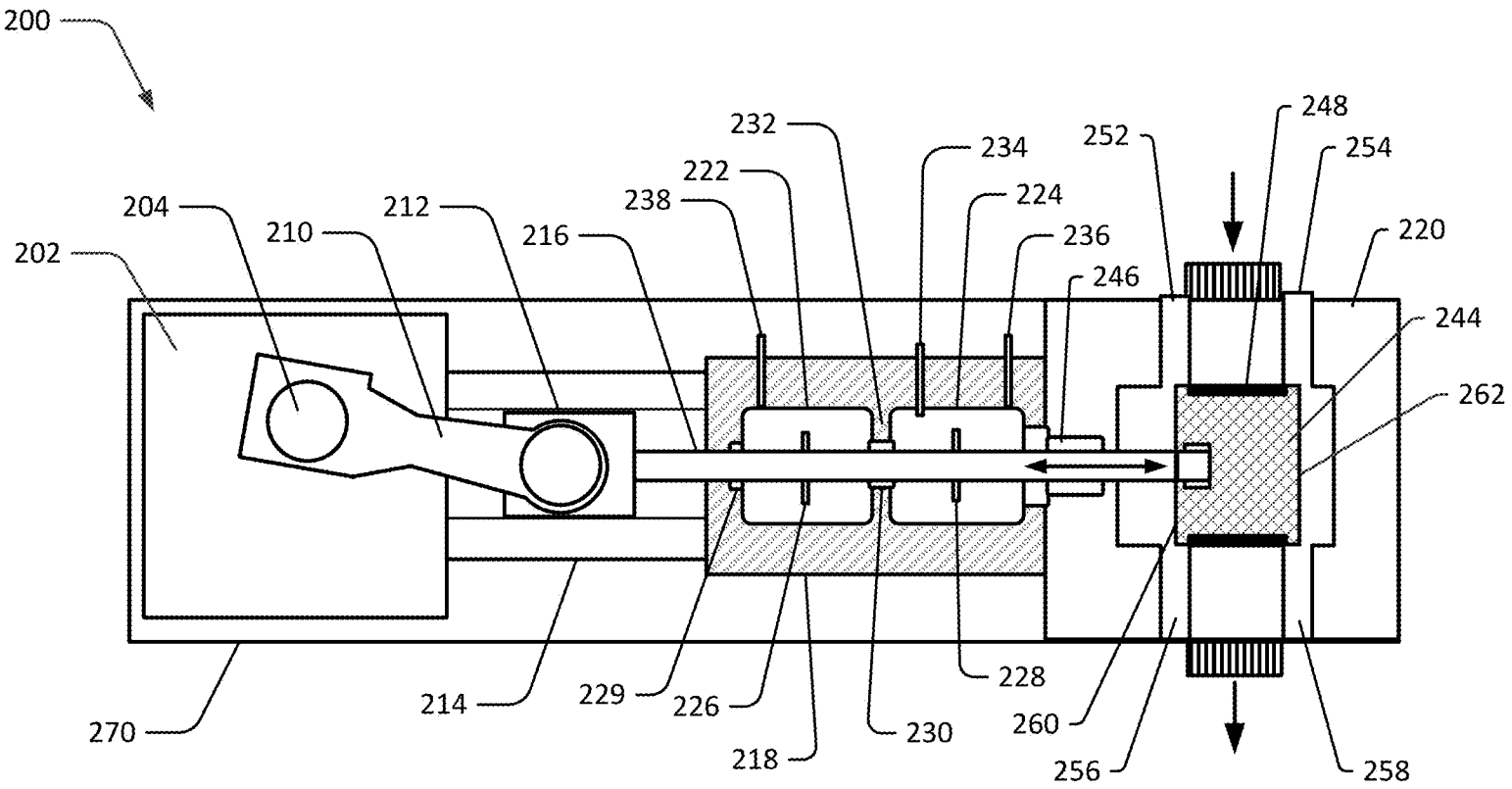
FIG. 2*a* illustrates an embodiment of a reciprocating compressor including a pressurized casing.
Figure 2B:
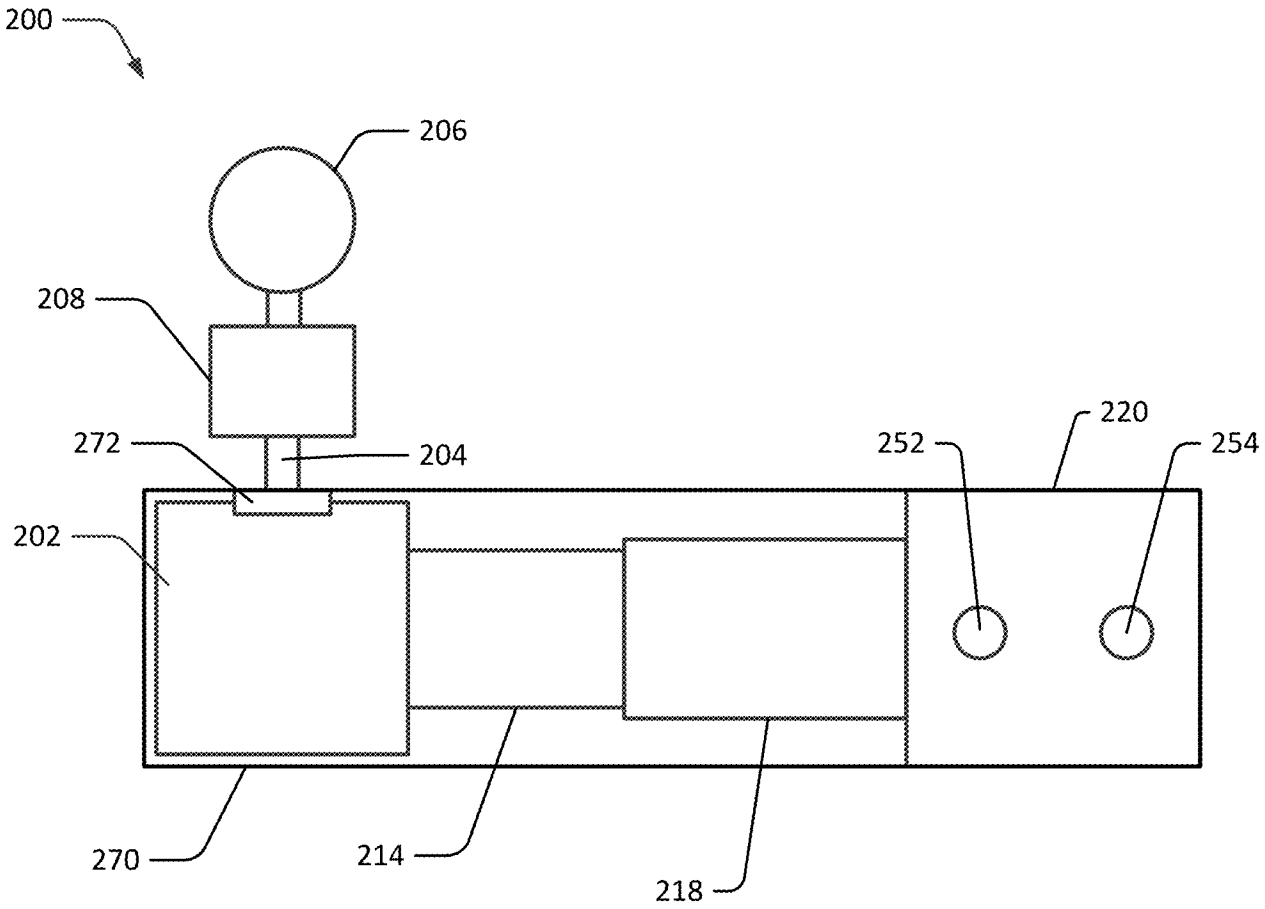
FIG. 2*b* illustrates a top view of the embodiment of the reciprocating compressor of FIG. 2*a* including a pressurized casing.

FIGS. 2*a* and 2*b* illustrate an embodiment of a reciprocating compressor 200 of the present disclosure. The reciprocating compressor illustrated is a double acting compressor; however, single acting compressors and diaphragm compressors are also contemplated. The reciprocating compressor 200 includes a compressor frame/crankcase 202 with a drive shaft 204 received therein and pressure casing 270. As noted above, the pressure casing is preferably held at a pressure in the range of the suction and discharge pressures of the process gas in the compression cylinder, including all values and ranges therein. The suction and discharge pressures are selected, in part, based on the type of supply line to which the compressor is affixed, including pipeline diameter, elevation, environment and process gas.

The drive shaft 204 is driven by a motor 206. In embodiments, the drive shaft may include a crankshaft. The motor 206 may drive a gearbox 208, which in turn drives the drive shaft 204 or drives the drive shaft directly. It is noted, in particular, that the motor is located externally to the pressurized casing discussed further below. The location of the motor outside of the pressurized casing allows access to the motor for cooling with fluids, including water, hydraulic fluid or air. The motor may be powered by the process fluid, particularly when the process fluid is natural gas. In other embodiments, the motor may be an electric powered motor.

The drive shaft is coupled to a piston rod via a rotary to linear motion converter. A rotary to linear motion converter is understood herein as one or more components that convert the rotary motion input from the drive shaft to the linear motion applied to the piston rod. In preferred embodiments, the rotary to linear motion converter is provided through the coupling of the rotatable drive shaft 204 to a connecting rod 210. The drive shaft may include a crank throw having a bearing surface whose axis is offset from the axis of the crank. At the opposing end of the connecting rod a sliding crosshead 212 is connected, which transfers the rotational motion of the connecting rod into a linear motion. As illustrated the big end of the connecting rod is affixed to the drive shaft and the small end to the crosshead. The crosshead 212 is mounted in a crosshead guide 214, which is an extension on the compressor frame 202. A piston rod 216 is affixed to and driven laterally in a reciprocating manner by the crosshead 212. It may be appreciated that other rotary to linear motion converters may be used to convert rotary motion of the drive shaft into the desired linear motion of the piston, such as a cam affixed to and rotating with the driveshaft or the use of lead screws.

The piston rod 216 is supported between the compressor frame 202 and the compression cylinder 220 by a distance piece 218, which provides spacing between the compressor frame 202 and the compression cylinder 220. There may be one or more compartments 222, 224 in the distance piece 218. To prevent oil migration between the compression cylinder 220 and the compression frame 202 one or more oil slingers 226, 228 may be provided on the piston rod 216 to prevent lubrication oil from entering the compressor frame 202. In addition, an oil wiper packing 229 may be provided where the distance piece 218 meets the compressor frame 202. Further, an intermediate packing 230 may be provided in the wall 232 between compartments 222, 224. Preferably, the distance piece is vented through a distance piece vent 234 to a vent, such as a blow-down stack or flare. In addition, purge buffer gas inlets 236, 238 may be provided at either end of the distance piece 218 to prevent process gas from entering the compressor frame 202.

Turning back to the piston rod 216, the piston rod 216 reciprocates a piston 244 within the compression cylinder 220 (i.e., the compression chamber). A pressure packing 246 is positioned around the piston rod 216 where the distance piece 218 and compression cylinder 220 meet. The pressure packing is positioned between the piston rod and the compression cylinder. The pressure packing 246 is provided to prevent process gas from exiting the compression cylinder 220 and exiting through the distance piece vent 234. The piston may be fitted with one or more wear bands 248, which are typically formed of a thermoplastic material, such as nylon or polytetrafluoroethylene, or of a lubricious metal or metal alloy coating. The lateral motion of the piston 244 compresses gas that enters the compression cylinder 220 through one or more inlet valves 252, 254. Movement of the piston away from a given inlet valve, towards the other valve allows the process gas to enter the compression cylinder. In embodiments, the process gas is sucked into or inducted into the compression cylinder from the inlet valve, at a process gas suction pressure. Movement of the piston back towards the given valve compresses the process gas and the compressed process, at the discharge pressure, gas exits the compression cylinder 220 through discharge valves 256, 258. Inlet and outlet valves may be selected from a number of valves including, but not limited to plate valves, concentric ring valves, poppet-style vales.

It may be appreciated that the compression cylinder 220 generally includes two sides, a first side 260 of the compression cylinder is defined by one side of the piston and the compression cylinder and a second side of the compression cylinder 262 is defined by the other side of the piston and the compression cylinder. When the process gas is being admitted into a first side of the compression cylinder 260, flow through the discharge valve 256 on that side of the compression cylinder is blocked and when compressed gas is discharged from the compression cylinder, back flow through the inlet valve 252 on that side of the compression cylinder is blocked. Further, when process gas is being admitted into a first side of the compression cylinder 260, process gas on the second side of the compression cylinder 262 is being compressed and discharged through the other discharge valve 258. And, when process gas is being compressed and discharged from the first side of the compression cylinder 260, process gas is admitted into the second side of the compression cylinder 262 through the second inlet valve 254. Thus, each side of the piston may exhibit a different pressure in the compression cylinder.

The pressure casing 270 is provided and encases the distance pieces from the compression cylinder to and around the compressor frame 202. In preferred embodiments, the pressure casing is sealed to the compression cylinder or around the entire compressor in conjunction with the compression cylinder. Preferably, the only process gas leakage path in the pressure casing 270 is to accommodate the drive shaft 204. Again, there may be circumstances where other leakage paths may be present, such as in gaps in the casing; these pathways should also be mitigated. As alluded to above, a seal 272 is provided between the casing wall and the drive shaft 204 to prevent gas from leaking out into the environment. In a preferred embodiment, the seal 272 is a mechanical seal, and more preferably, a rotating seal, rather than sliding packing seals. In particularly preferred embodiments, the seal is a dry gas seal.

Figure 3:
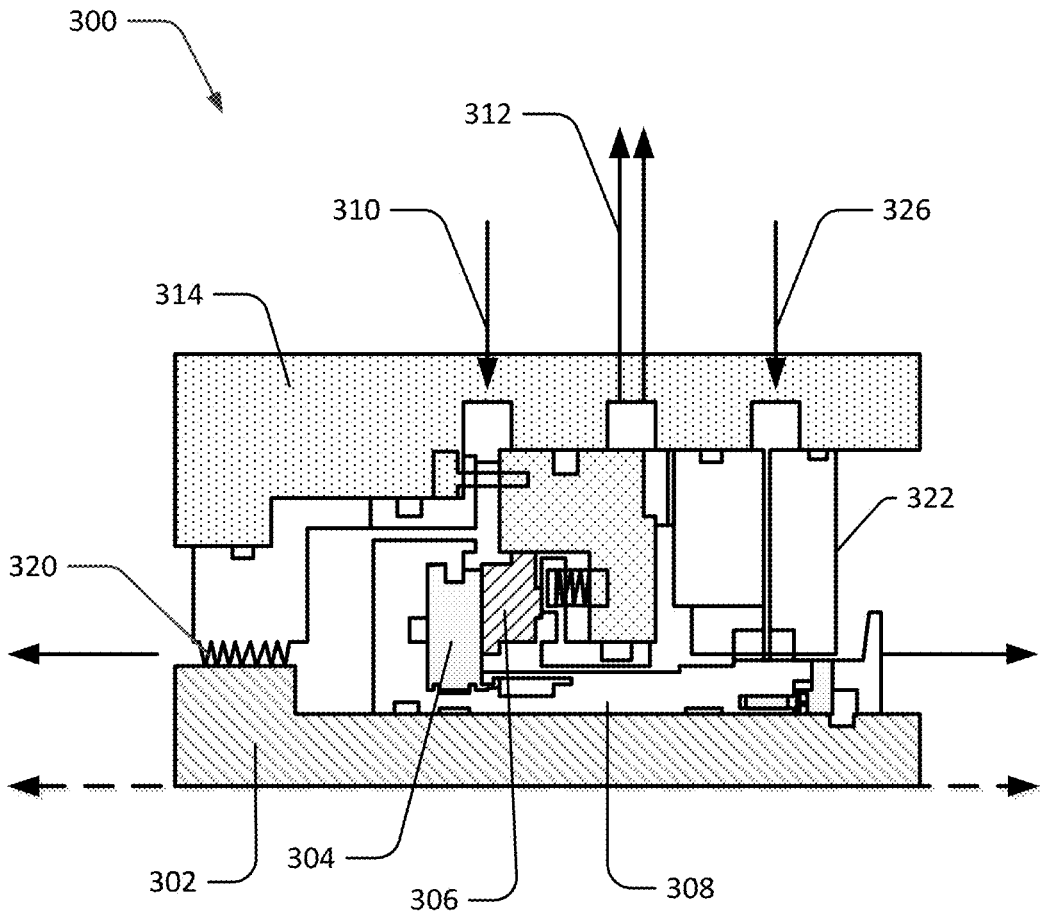
FIG. 3 illustrates an embodiment of a dry gas seal positioned between a driveshaft and the pressure casing.

A schematic illustration of a cross-section of an embodiment of a preferred dry gas seal is provided in FIG. 3, which illustrates half of the seal cross-section (the other half mirroring the illustrated half). A dry gas seal 300 mounts on the drive shaft 302 and generally includes a mating, rotating ring 304 and a stationary ring 306. The mating ring 304 is axially secured in place by a locking sleeve 308 and rotates with the drive shaft 302. In operation, the mating ring provides a fluid-dynamic force causing the stationary ring to separate from the mating ring, creating a gap between the mating ring and stationary ring. The fluid-dynamic force is created, in part, due to the introduction of a sealing gas through the sealing gas inlet 310. Excess gas is vented through a vent 312 provided in the housing 314. The internal labyrinth 320 prevents the process gas from entering the gas seal. A barrier seal 322 is provided to separate the gas seal from the crankshaft bearings. Separation gas is injected into the barrier seal, through a separation gas seal port 326. A portion of the separation gas may pass through the vent 312. It may be appreciated that instead of the illustrated single dry gas seal, a tandem style dry gas seal or double opposed seals may be utilized.

Figure 4:
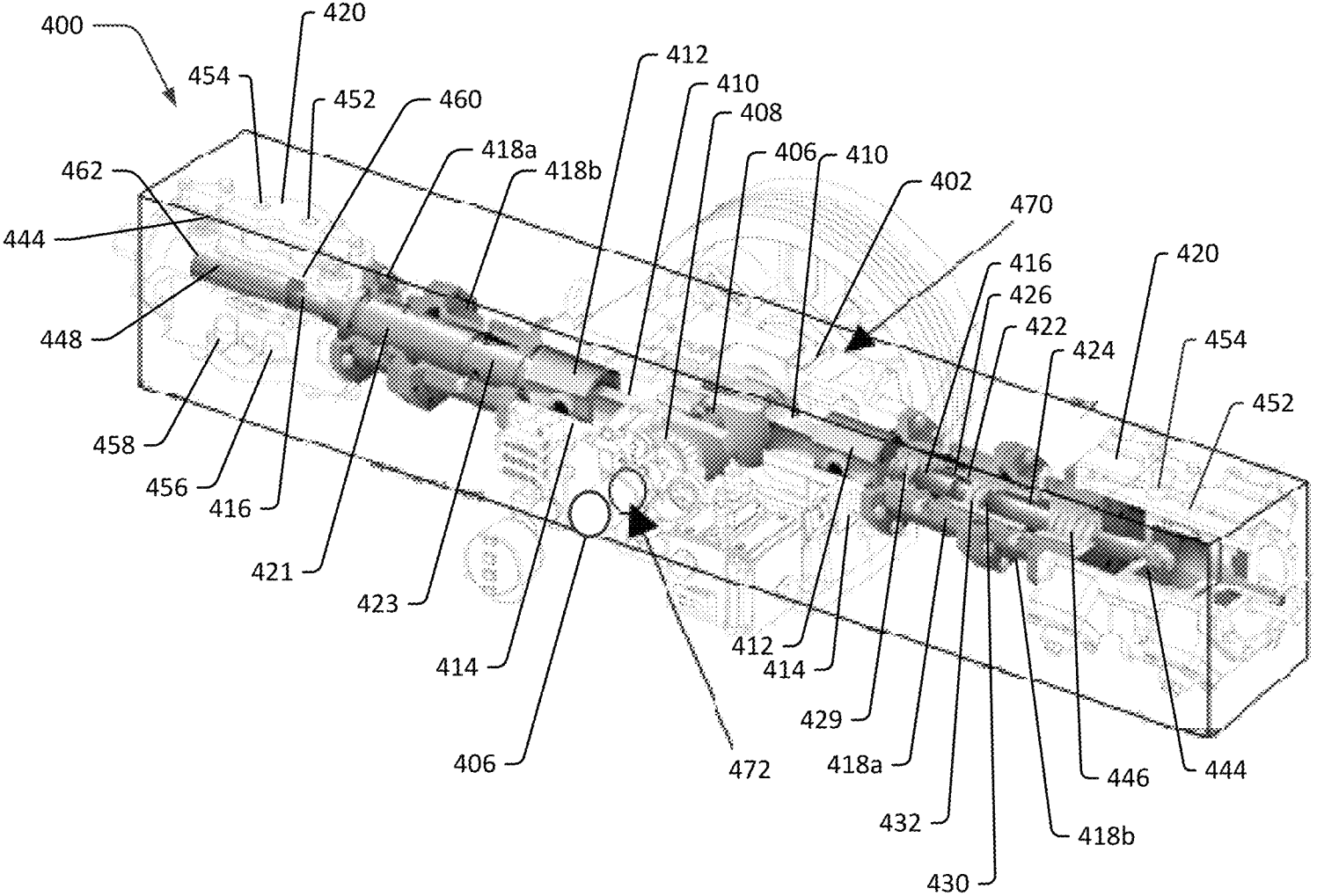
FIG. 4 illustrates a schematic of another embodiment of a reciprocating compressor positioned in a pipeline including a pressurized casing.

FIG. 4 illustrates another, preferred, embodiment of a reciprocating compressor 400, which in this case is a "T" style compressor. The compressor includes two pistons arranged in a balanced-opposed configuration, such that the motion of one piston is balanced by the motion of the opposing piston. Again, the compressor pistons may be single acting or double acting (which is illustrated). Diaphragm compressors are also contemplated. The reciprocating compressor 400 includes a compressor frame/crankcase 402 with a drive shaft 404 located therein. Again, the pressure casing 470 is held at a pressure in the range of the process gas suction and discharge pressures, including all values and ranges therein.

The drive shaft 404 is driven by a motor 406. In embodiments, the drive shaft may include a crankshaft. In embodiments, the motor 406 drives a gearbox 408, this in turns drives the drive shaft 404. In embodiments, the motor may be powered by the process fluid, such as when the process fluid is natural gas. In other embodiments, the motor may be an electric powered motor. As in the embodiment above, the motor is located externally to the pressure casing, discussed below. The location of the motor outside of the pressurized casing allows access to the motor for cooling with fluids, including water, hydraulic fluid or air.

The drive shaft is coupled to a piston rod via a rotary to linear motion converter. A rotary to linear motion converter is understood herein as one or more components that convert the rotary motion input from the drive shaft to the linear motion applied to the piston rod. The drive shaft may include a crank throw having a bearing surface whose axis is offset from the axis of the crank. In preferred embodiments, rotation of the drive shaft 404 drives opposing connecting rods 410, connecting at the big end to the crank throw and at the little end to a sliding crosshead 412 mounted in a crosshead guide 414, which is an extension on the compressor frame 402. A piston rod 416 is affixed to and driven laterally in a reciprocating manner by the crosshead 412.

Each piston rod 416 is supported by inner and outer distance pieces 418*a*, 418*b*, respectively, which provide spacing between the compressor frame 402 and the compression cylinders 420. There may be one or more compartments 422, 424 in the distance piece 418. A packing cartridge body 421 and packing cartridge adapter 423 may be provided to hold the packing, described further herein. To prevent oil migration between the compression cylinders 420 and the compression frame 402 one or more oil slingers 426 may be provided on each piston rod 416 to prevent lubrication oil from entering the compressor frame 402. In addition, an oil wiper packing 429 may be provided where the distance piece 418 meets the compressor frame 402 and held in place by the packing cartridge adapter 424. Further, an intermediate packing 430 may be provided in the wall 432 between the distance pieces 418*a*, 418*b*. Preferably, the distance piece is vented through a vent, such as a blow-down stack or flare.

Turning back to the piston rods 416, the piston rods 416 reciprocate a piston 444 within each compression cylinder 420 (i.e., the compression chamber). A pressure packing 446 is positioned around the piston rod 416 where the distance piece 418 and compression cylinder 420 meet. The pressure packing 446 is provided to prevent process gas from exiting the compression cylinder 420. The piston may be fitted with one or more wear bands 448, which are typically formed of a thermoplastic material such as nylon or polytetrafluoroethylene, or a metal or metal alloy. The lateral motion of the pistons 444 compress the process fluid that enters the compression cylinder 420 through one or more inlet valves 452, 454 and is discharged through one or more discharge valves 456, 458. Movement of the piston away from a given inlet valve, such as valve 452, towards the other inlet valve, such as valve 454, allows the process gas to enter the compression cylinder at a suction pressure. Movement of the piston back towards the given inlet valve compresses the process gas and the compressed process gas exits the compression cylinder through the discharge valve associated with the inlet valve at a discharge pressure. Inlet and outlet valves may be selected from a number of valves including, but not limited to plate valves, concentric ring valves, poppet-style vales.

It may be appreciated that each compression cylinder 420 generally includes two sides, a first side 460 of the compression cylinder is defined by one side of the piston and the compression cylinder and a second side of the compression cylinder 462 is defined by the other side of the piston and the compression cylinder. When the process gas is being admitted into a first side of the compression cylinder 460, flow through the discharge valve 456 on that side of the compression cylinder is blocked and when compressed gas is discharged from the compression cylinder, back flow through the inlet valve 452 on that side of the compression cylinder is blocked. Further, when process gas is being admitted into a first side of the compression cylinder 460, process gas on the second side of the compression cylinder 462 is being exhausted through the other discharge valve 458. And, when process gas is being discharged from the first side of the compression cylinder 460, process gas is admitted into the second side of the compression cylinder 462 through the second inlet valve 454.

As noted, the pressure casing 470 is provided and encases the distance pieces from the compression cylinder to and around the compressor frame 402. As illustrated, the pressure casing surrounds the entire compressor, including around the compression cylinders, and creates a casing around the compressor in conjunction with the compression cylinder. Preferably, the openings in the pressure casing 470 are to accommodate the drive shaft 404 and the supply lines to the inlet valves 452, 454 and the discharge valves 456, 458. A seal 472 is provided between the casing wall and the drive shaft 404 to prevent gas from leaking out into the environment. In a preferred embodiment, the seal is a mechanical seal, and more preferably, a rotating seal, rather than sliding packing seals. In particularly preferred embodiments, the seal is a dry gas seal as illustrated in FIG. 3 above.

Due to leakage in the system, the pressure casings raise the system pressure levels. This increase in system pressure levels reduces leakage from the compression cylinder through the packing seals due to a decrease in the pressure ratio between the pressure casing and the compression cylinder. The incorporation of a reclamation system may assist in maintaining elevated pressure levels, and is described further below. However, in the case of over pressure, a release valve may be coupled to the pressure casing to relieve pressure should the pressure levels exceed a value deemed to be the operating limit. Such limit may be determined based on the integrity and materials selected in the system.

Figure 5:
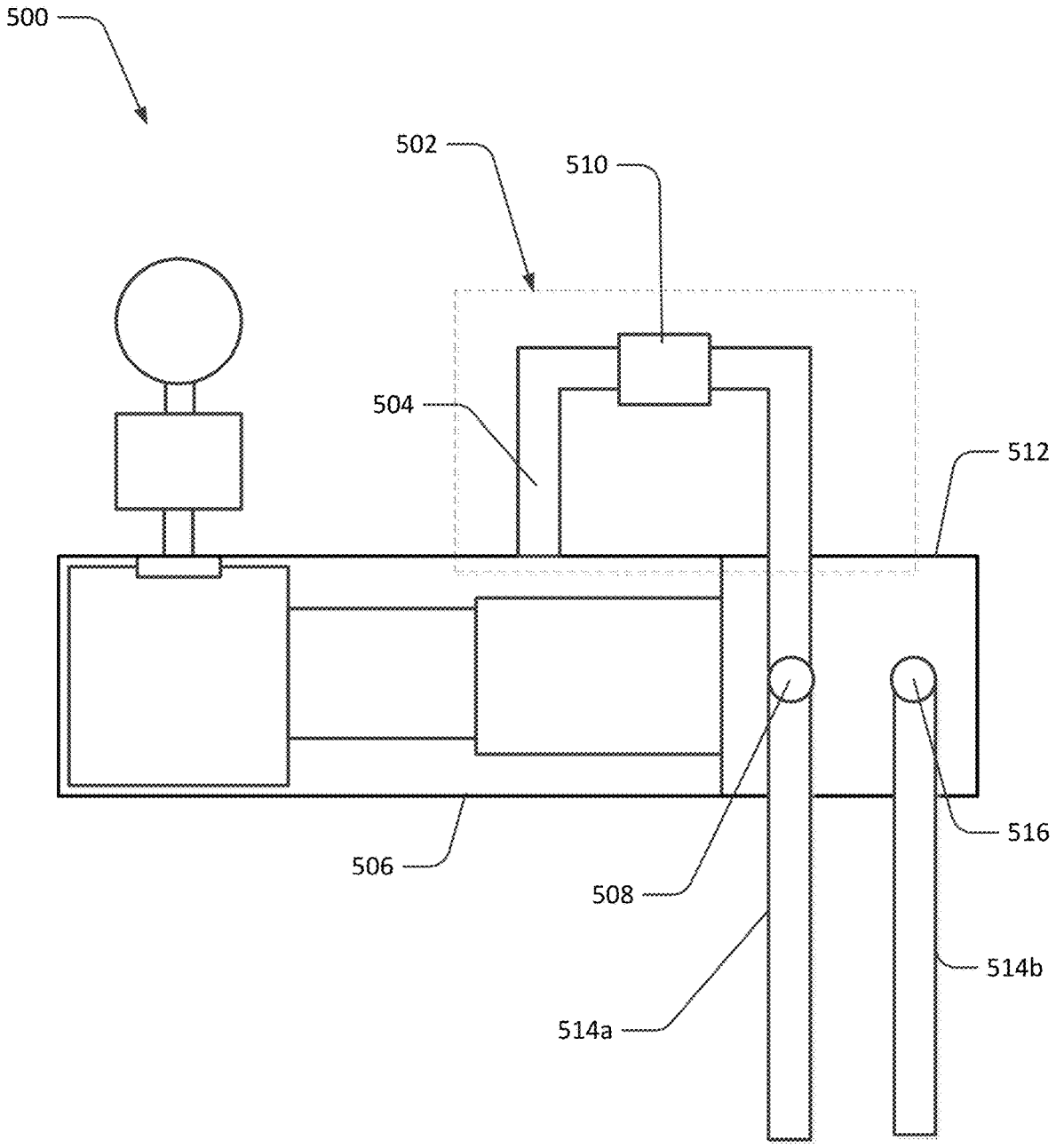
FIG. 5 illustrates a schematic of an embodiment of a reciprocating compressor placed in a supply line and a reclaiming system to collect and recompress leaked process fluid.

FIG. 5 illustrates a schematic of a reciprocating compressor 500 used in combination with a reclamation system 502. The reclamation system preferably includes a flow pathway 504 coupled between the pressure casing 506 and at least one of the compression cylinder inlet valves 508. The reclamation system also includes a filter 510 coupled to said flow pathway for removing particles, such as lubricant particles or hydrocarbon particles that may be entrained in the recaptured process fluid. The process fluid is then reintroduced through an inlet value 508 into the compression cylinder 512 to be compressed. The connections between the flow pathway and the pressure casing, the filter, and the inlet valves are preferably sealed to prevent leakage.

As noted above, the reciprocating compressors may be incorporated into a number of systems, including oil and natural gas pipelines, chemical plant and refrigeration applications. In a particularly preferred embodiment, the reciprocating compressors described above are incorporated into natural gas pipelines in compressor stations. The compressor stations compress the natural gas as it travels through the pipelines. The compression of the gas allows the gas to continue flowing through the pipe to distribution points and end-users, including refineries, commercial customers and residential customers. Compressor stations may include auxiliary equipment to remove impurities such as liquids, dirt, particles, and other impurities including water and hydrocarbons. Such auxiliary equipment includes scrubbers, strainers, or filter separators. In addition, operating pressures may vary from 200 pounds per square inch (psi) to 10,000 psi, including all values and ranges therein. Operating pressure depend upon factors such as pipeline diameter, elevation, environment and process gas.

Referring again to FIG. 5, the reciprocating compressor 500 is coupled in the flow path of a supply line 514*a*, 514*b*. A first portion of the supply line 514*a* is connected to the inlet valve(s) 508. A second portion of the supply line 514*b* is also connected to the discharge valve(s) 516. The process fluid in the supply line 514*a* is inducted into the inlet valve 508. It is then compressed within the compression cylinder 512 and discharged into the supply line 514*b* through the discharge valve 516. Again, the inlet valve 508 prevents back flow into supply line 514*a* when the process gas is being compressed and discharged. The discharge valve 516 prevents back flow from the supply line 514*b* when process fluid is being inducted into the compression cylinder 512 and may prevent flow into the supply line 514*b* until the compressed process fluid reaches a desired pressure.

Figure 6:
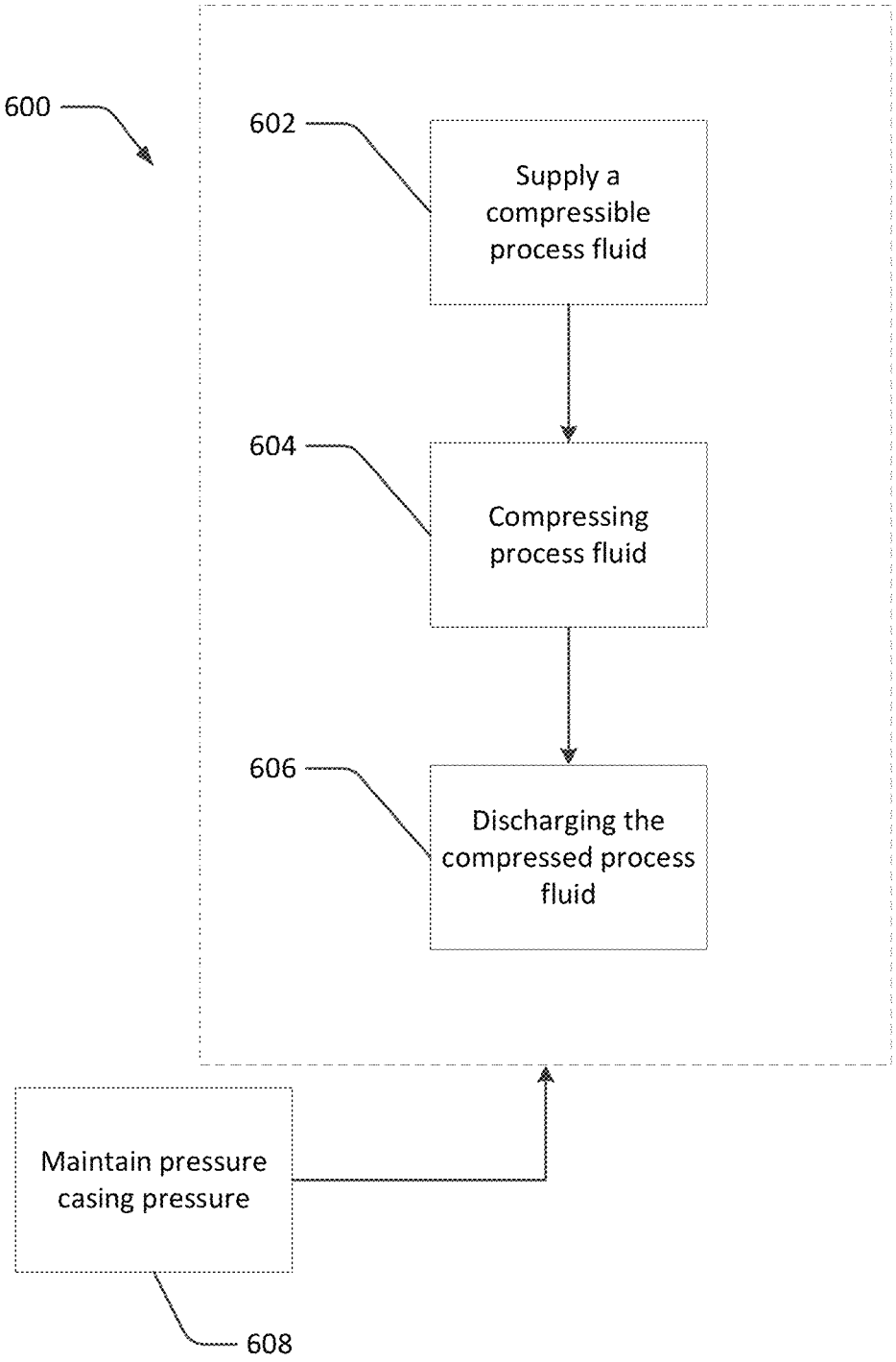
FIG. 6 illustrates a flow diagram of a method of compressing a process fluid.

Also contemplated herein is a method of operating a reciprocating compressor as illustrated in FIG. 6. The method 600 includes supplying a compressible process fluid to a reciprocating compressor 602 from a supply line for the process fluid. Again, the process fluid may include liquid or gas that is compressible, i.e., changes in volumes with changes in pressure acted upon the fluid. The fluid may be supplied by inducting the fluid into the compression cylinder at a process gas suction pressure. In preferred embodiments, the process fluid is natural gas and the supply line is a natural gas pipeline. The method also includes compressing the process fluid 604 and discharging the compressed process fluid 606 at a discharge pressure from the compression cylinder. In preferred embodiments, where the process fluid is natural gas, the process fluid is preferably compressed to a pressure in the range of 200 psi to 10,000 psi, including all values and ranges therein. During the method 608, the pressure within the pressure casing is maintained in the range of the process gas suction and discharge pressures to reduce leakage from the compression cylinder. The suction and discharge pressures are selected, in part, based on the type of supply line to which the compressor is affixed including pipeline diameter, elevation, environment and process gas. Again, the pressure in the pressure casing may be maintained by the use of a reclamation loop or a relief valve.

The above systems and methods reduce leakage of the process gas into the environment, and it is contemplated that the emission may be virtually eliminated. When considered at the amount of leakage that may be reduced worldwide, the reductions in leakage are believed to be relatively substantial.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

The invention claimed is:

1. A reciprocating compressor, comprising:

a compressor frame including a drive shaft received therein;

a rotary to linear motion converter coupling said drive shaft and a first end of a piston rod;

a pressure casing encasing said compressor frame and said rotary to linear motion converter;

a piston coupled to a second end of said piston rod;

a gas compression cylinder in which said piston is received, said gas compression cylinder disposed external to the pressure casing;

an inlet valve coupled to said gas compression cylinder and a discharge valve coupled to said gas compression cylinder; and a seal coupled between said drive shaft and said pressure casing, said seal to maintain an operating pressure within said pressure casing, said operating pressure including a pressure between a gas suction pressure at said gas compression cylinder and a gas discharge pressure at said gas compression cylinder based on movement of the piston.

2. The reciprocating compressor of claim 1, wherein said seal is a rotating seal.

3. The reciprocating compressor of claim 2, wherein said rotating seal is a dry gas seal.

4. The reciprocating compressor of claim 1, wherein said rotary to linear motion converter comprises a connecting rod driven by said drive shaft; and a crosshead affixed to said connecting rod, wherein said crosshead is configured to transfer the rotational motion of the connecting rod to a linear motion, said crosshead being slidably mounted in a crosshead guide and said piston rod is coupled to the crosshead.

5. The reciprocating compressor of claim 4, wherein a distance piece is provided between said crosshead guide and said gas compression cylinder and said piston rod is supported by said distance piece.

6. The reciprocating compressor of claim 5, wherein a pressure packing is received between said gas compression cylinder and said distance piece.

7. The reciprocating compressor of claim 1, further comprising a second inlet valve coupled to said gas compression cylinder and a second discharge valve coupled to said gas compression cylinder, wherein said reciprocating compressor is a double acting compressor.

8. The reciprocating compressor of claim 1, further comprising a reclamation system including a flow pathway coupled to said pressure casing and to said gas compression cylinder inlet valve.

9. The reciprocating compressor of claim 8, further comprising a filter coupled to said flow pathway.

10. A supply line including a reciprocating compressor affixed in the flow path thereof, comprising:

a compressor frame including a drive shaft received therein;

a rotary to linear motion converter coupling said drive shaft to a first end of a piston rod;

a pressure casing encasing said compressor frame and said rotary to linear motion converter;

a piston coupled to a second end of said piston rod;

a gas compression cylinder in which said piston is received, said gas compression cylinder disposed external to said pressure casing;

an inlet valve coupling a first portion of said supply line to said gas compression cylinder and a discharge valve coupling said gas compression cylinder to a second portion of said supply line; and a seal coupled between said drive shaft and said pressure casing, said seal to maintain an operating pressure within said pressure casing, said operating pressure including a pressure between a gas suction pressure at said gas compression cylinder and a gas discharge pressure at said gas compression cylinder based on movement of the piston.

11. The supply line of claim 10, wherein said seal is a rotating seal.

12. The supply line of claim 10, wherein said rotating seal is a dry gas seal.

13. The supply line of claim 10, wherein said rotary to linear motion converter comprises a connecting rod driven by said drive shaft; and a crosshead affixed to said connecting rod, wherein said crosshead is configured to transfer the rotational motion of the connecting rod to a linear motion, said crosshead being slidably mounted in a crosshead guide and said piston is coupled to the crosshead.

14. The supply line of claim 13, wherein a distance piece is provided between said crosshead guide and said gas compression cylinder, wherein said piston rod is supported by said distance piece.

15. The supply line of claim 14, wherein a pressure packing is received between said gas compression cylinder and said distance piece.

16. The supply line of claim 15, wherein said supply line is a natural gas pipeline.

17. A reciprocating compressor, comprising:

a compressor frame including a drive shaft received therein;

a rotary to linear motion converter coupling said drive shaft and a first end of a piston rod;

a pressurized casing encasing said compressor frame and said rotary to linear motion converter;

a compression cylinder disposed external to said pressure casing;

at least a first inlet valve coupled to said compression cylinder to receive a compressible process fluid;

at least a first discharge valve coupled to said compression cylinder to discharge the compressible process fluid; and a piston coupled to a second end of said piston rod, the piston to be received within the compression cylinder between the first inlet valve and the first discharge valve to generate suction pressure to cause said process fluid to enter said compression cylinder, and generate discharge pressure to discharge the compressible process fluid based on said rotary to linear motion converter; and a seal coupled between said drive shaft and said pressure casing to hold said pressurized casing at a pressure in a range between 200 psi and 10,000 psi based at least in part on said generated suction pressure.

18. The reciprocating compressor of claim 17, wherein said compressible process fluid comprises a gas, and wherein said seal coupled between said drive shaft and said pressure casing includes a sealing gas inlet to receive said gas to hold said pressurized casing at said pressure.

19. The reciprocating compressor of claim 17, wherein said pressurized casing is held at a first pressure when said compressible process fluid enters said compression chamber based on said generated suction pressure, and said pressurized casing is held at a second pressure when said compressible process fluid discharges based on said generated discharge pressure.

20. The reciprocating compressor of claim 17, further comprising a reclamation system, the pressurized casing held at said pressure based at least in part on said reclamation system providing a flow pathway coupled between said pressurized casing and said compression cylinder to receive compressible process fluid leaked from said compression cylinder by way of at least one compression cylinder inlet valve, said flow pathway of said reclamation system further to provide said received compressible process fluid to said compression cylinder to recompress and discharge said received compressible process fluid via said first discharge valve.

* * * * *